United States Patent [19]

Westermeyer

[11] Patent Number: 4,614,928

[45] Date of Patent: Sep. 30, 1986

[54] AUTOMATIC SWITCH WITH AN ARC BLAST FIELD

[75] Inventor: Joseph Westermeyer, Nuremberg, Fed. Rep. of Germany

[73] Assignee: Sursum Elektrizitatsgesellschaft Leyhausen GmbH & Co., Nuremberg, Fed. Rep. of Germany

[21] Appl. No.: 664,012

[22] Filed: Oct. 23, 1984

[30] Foreign Application Priority Data

Oct. 29, 1983 [DE] Fed. Rep. of Germany ..... 3339399

[51] Int. Cl.[4] ..... H01H 9/30; H01H 33/18

[52] U.S. Cl. ..... 335/201; 200/147 R

[58] Field of Search ..... 335/201; 200/147 A, 200/147 R

[56] References Cited

U.S. PATENT DOCUMENTS

| | | | |
|---|---|---|---|
| 2,343,323 | 3/1944 | Pierce | 200/147 R |
| 3,246,098 | 4/1966 | Hall . | |
| 4,001,743 | 1/1977 | Arnhold | 335/201 |
| 4,206,430 | 6/1980 | Rusch et al. | 335/20 |
| 4,223,288 | 9/1980 | Stiner | 335/20 |
| 4,301,342 | 11/1981 | Castonguay | 335/17 |

FOREIGN PATENT DOCUMENTS

| | | | |
|---|---|---|---|
| 1904731 | 8/1970 | Fed. Rep. of Germany . | |
| 2813431 | 10/1979 | Fed. Rep. of Germany | 335/201 |

*Primary Examiner*—Harold Broome

*Attorney, Agent, or Firm*—Holman & Stern

[57] ABSTRACT

An automatic switch wherein a movable switch lever bears a contact element which cooperates with a fixed contact element bonded to a ferromagnetic contact strip which serves to provide a compact arc-extinguishing device. The ferromagnetic metal strip is mounted on the side of the contact element and/or on the movable switch lever's contact element on the side(s) directed away from the electrical contact surface(s). The application of the metal strip, or "blow plate," substantially improves the process of conducting away contact arcs from the contact elements to a set of deionization plates mounted inside the switch assembly.

5 Claims, 2 Drawing Figures

AUTOMATIC SWITCH WITH AN ARC BLAST FIELD

FIELD OF THE INVENTION

The invention relates to an automatic switch wherein a magnetic arc-blowing field may be internally generated with standard static components found in most electrical switches and relays.

In a known automatic switch of this type (Swiss Pat. No. 441,486), one contact element is comprised of a single U-shaped plate or strip of metal. The curved contact strip itself serves to arrest arcs which arise when the contact elements are closed and to conduct said arcs away to a set of deionization plates. The removal of such arcs is often unsatisfactory in this known small automatic switch.

A major requirement of a small automatic switch is a high circuit-breaking (current) rating. Since a small switch has small, low-mass contacts, it is important that the arc generated by opening or closing the contacts be removed quickly from the contact elements and be taken up quickly by some sort of arc-conducting plate. Numerous arrangements are known for solving this problem, e.g., the use of extinguishing coils or "blowing loops" which produce a magnetic field in the region of the opened contacts. However, known arrangements are costly. In particular, they require a great deal of space, which of course is unavailable in modern, narrow, miniature automatic switches.

As a rule, it is sufficient if the arc-extinguishing mechanism (hereinafter "blow plate") is associated only with the fixed contact element. However, further improvement can be achieved if the movable contact element is also provided with such a "blow plate." But, with the movable contact it is necessary to firmly fasten the "blow plate" to that contact, and this usually means that the action of the movable contact is interfered with when it bears a "blow plate" because, with increased weight, it opens slower.

Another exemplary design for consideration is that according to Ger. Pat. No. 190,473 or Ger. Pat. No. 1,966,598, wherein the return strip of the tripping magnet serves as a support for the fixed contact element. This enables the fixed contact element and the blow plate to be embodied in a single form which advantageously influences the overall arc-arresting behavior.

Accordingly, it is an object of the invention to devise an automatic switch of the type above-described, typically with thermal override, which switch has the improved removal of contact arcs required for a high-amperage rating by virtue of an arc-blowing device which is economical, compact, and convenient.

SUMMARY OF THE INVENTION

This is achieved according to the invention by an automatic switch characterized in that a ferromagnetic metal strip is mounted on the backside of the switch's fixed contact element and/or on the movable switch lever on the side which is directed away from the contacting side of the element.

The removal of contact arcs from the contact elements to the deionization plates is substantially improved with the use such an inserted metal strip, and it is particularly advantageous if the fastened blow plate (metal strip) extends over the entire width of the curved contact element in the switch and if said blow plate narrows in width along with the contact strip at each end. This configuration provides optimal arc-removal properties.

In the switch of this invention, the movable switch lever bears a contact element which cooperates with a fixed contact element disposed on the transverse part of a "U-shaped" curved contact strip. This strip forms a loop, one end of which is connectable to any electric circuit external to the switch and the other end of which stands free so as to form an arrestor terminal which is associated with a group of ordinary deionization plates. A strip of iron about 0.8 mm thick, for example, is bonded to the nonferrous fixed contact element (and possibly also on the movable contact element) on the side thereof which faces away from the contact locus, so as to conform closely to the shape of said element(s). Instead of a separately manufactured blow plate, an iron strip and a copper strip may be rolled together to comprise a two-layered bimetallic strip forming the blow plate and contact element respectively, thereby providing a magnetic rear path for the contact element's arc. In this way the inherent magnetic field arising from the contact element (and blow plate) is used to create a strong accelerating force which acts on the generated arc so as to conduct it more quickly to the deionization plates.

A preferred embodiment of the invention is illustrated in the drawings.

DETAILED DESCRIPTION OF DRAWINGS

Figure 1:
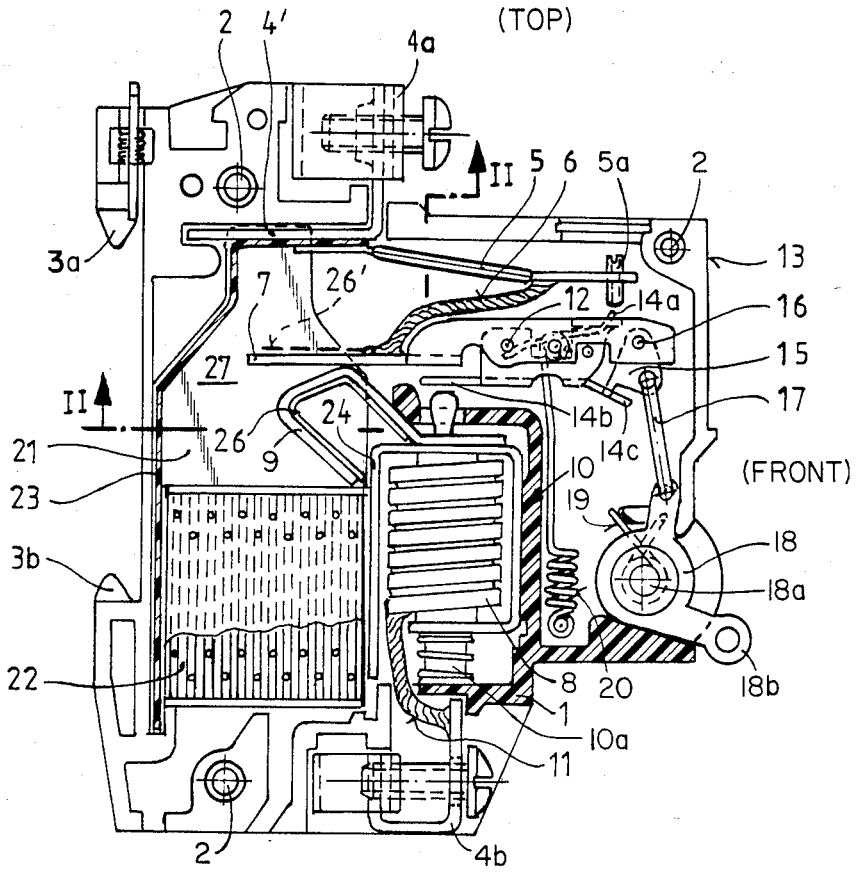
FIG. 1 is a cutaway side view of the automatic switch with a curved contact strip.

With reference to FIG. 1, the automatic switch illustrated is comprised of several components, including a narrow housing, or box, 1 and a cover (not shown) which is placed on said housing. There are three eyelets 2 on the sidewalls of the box 1 which eyelets correspond with matching boreholes which may be used to register the cover and through which rivets may be inserted to hold the housing fastened together. Mutually facing hooks 3*a* and 3*b* are disposed on the rear side of the housing, one of which hooks 3*a* is spring-loaded. These hooks serve as a means for mounting the housing 1 on rails or other equivalent superstructure.

A screw clamp 4*a* is disposed on an upper transverse face, and another screw clamp 4*b* is disposed on a lower transverse face; conductors for supplying and conducting away current can be connected to said screw clamps (terminals). The upper screw clamp 4*a* is mounted on a support element 4' which extends into the housing 1 and bears a bimetallic tripping element 5. A thermostatic (bimetallic) tripping element 5 is connected to a switch lever 7 via a stranded metal wire 6. Switch lever 7 has the form of a movable contact which cooperates with the fixed contact element 9. Fixed contact element 9 is electrically connected to the coil 8 of an impact-armature tripping element, or solenoid, 10 equipped with a spring-loaded rod 10*a*. The other end of the coil 8 is electrically connected to the lower screw clamp 4*b* via a stranded metal wire 11.

The switch lever 7 is mounted so as to pivot about an axis peg 12. The arm of lever 7, which is directed toward the front side 13 of the switch assembly, has rotatably mounted on it a three-armed arresting lever 14. The bimetallic tripping element 5 acts on one arm of the arresting lever 14*a* via an adjustable set screw 5*a*. The rod 10*a* of the other tripping element acts on the second arm of lever 14*b*. The third arm of the arresting lever 14*c* cooperates with a detent lever 15 which is pivotally mounted on a peg 16 on the forward end of the switch lever 7. One end of a link piece 17 is also pivotally mounted on detent lever 15 but on a different axis. The other end of the link piece 17 is pivotally connected to a hand lever 18 which itself is pivotally mounted on a peg 18*a* such that the grip member 18*b* extends through an opening in the forward sidewall 13. Hand lever 18 is spring-loaded by a flat wire spring 19 which tends to bring the grip member 18*b* to its uppermost position which corresponds to the "open" state of the switch. Further, switch lever arm 7 is secured by a tension spring 20.

A set of deionized plates 22, of generally known composition, is disposed inside the arc chamber 21 where the contact elements 7 and 9 are also disposed. An arresting plate 23, attached to the support member 4', and another arresting plate 24, attached to the impact-armature tripping device 10, run vertically parallel to the deionization plates 22. The fixed contact element 9 is a flat strip arranged in an "offset-U" shape; it is typically a nonferrous conductor and is rigidly fastened to the impact-armature tripping device 10 as indicated above. The lower end of the contact element 9 is disposed toward the upper end and along the edges of the deionization plates 22.

Figure 2:
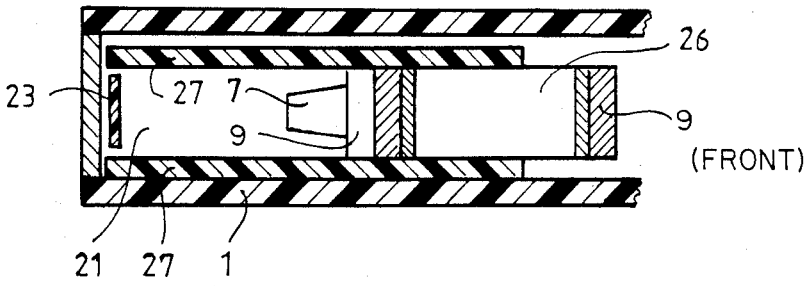
FIG. 2 is a bottom-view cross-section through segment II—II of FIG. 1.

A ferromagnetic metal strip 26 about 0.8 mm thick is mounted inside the "U-curved" contact element 9 so as not to abut the switch lever 7 directly. This metal strip 26 is bonded to the contact element 9 along its entire length; this structure constitutes the blow plate which is central to the invention. The metal strip 26 is substantially thinner than the contact element 9 (see FIG. 2). There is no other substantial laminar element between the nonferrous "U-curved" contact element 9 and the ferromagnetic strip 26.

Two ceramic insulating plates 27 (only one such plate is shown in FIG. 1) form and insulate the part of the arc chamber 21 which is unoccupied by the set of deionization plates 22.

Optionally, another blow plate may be incorporated into the switch assembly of FIG. 1 where a second ferromagnetic strip 26' could be mounted on the noncontacting side of the switch lever 7.

What is claimed is:

1. An automatic switch with an arc blowing field, comprising:

a rotatably mounted switch arm bearing a moving contact piece; said switch arm cooperating with fixed contact piece; said fixed contact piece being disposed on a crosspiece of a U-shaped curved contact strip;

said contact strip forming a loop; one end of said contact strip being connected to an electrical circuit and the other end of said contact strip being free;

said contact strip forming a diversion horn and being associated with a group of deionization plates which are in electrical communication with at least one arc-conducting plate; a return plate of a tripping solenoid supporting said fixed contact piece; said contact strip extending across a spaced width between two ceramic insulating discs;

a ferromagnetic plate strip being attached to said contact strip on a side of said contact strip facing away from said contact piece; and said ferromagnetic plate strip being disposed entirely in said loop of said contact strip.

2. The automatic switch of claim 1, wherein a second ferromagnetic metal strip is bonded to a noncontacting surface of contact piece of said switch arm.

3. The automatic switch of claim 1, further comprising a circuit-breaking means which includes a bimetallic thermal-override strip which, upon a predetermined expansion, cooperates with a separate pivotal assembly to move said contact piece off and electrically out of contact with said fixed U-shaped contact strip.

4. The automatic switch of claim 3 wherein said separate pivotal assembly further comprises a first arm, which cooperates with said thermal-override strip, a second arm which cooperates with said tripping solenoid which is electrically connected between one of a plurality of terminals and said contact strip, and a third arm which cooperates with a manual lever used to selectively move said moving contact piece into electrical communication with said fixed contact piece.

5. An automatic switch according to claim 1, wherein a second ferromagnetic plate strip extends across a width of said moving contact piece; said moving contact piece having a free end; said width of said second ferromagnetic plate strip tapering along with said moving contact piece toward said free end of said moving contact piece.

* * * * *